US007988484B1

(12) United States Patent
Jacoby

(10) Patent No.: US 7,988,484 B1
(45) Date of Patent: Aug. 2, 2011

(54) ELECTRICAL CORD COUPLING DEVICE

(76) Inventor: Joseph Jacoby, Maple Shade, NJ (US)

( * ) Notice: Subject to any disclaimer, the term of this patent is extended or adjusted under 35 U.S.C. 154(b) by 26 days.

(21) Appl. No.: 12/586,420

(22) Filed: Sep. 22, 2009

(51) Int. Cl.
*H01R 13/62* (2006.01)

(52) U.S. Cl. ..... 439/369; 439/367

(58) Field of Classification Search ..... 439/369, 439/367

See application file for complete search history.

(56) References Cited

U.S. PATENT DOCUMENTS

| | | | | |
|---|---|---|---|---|
| 3,281,755 | A | 10/1966 | Trager | |
| 4,911,654 | A | 3/1990 | Blaetz | |
| 5,299,951 | A * | 4/1994 | Blaetz | 439/367 |
| 5,393,243 | A | 2/1995 | Carmo | |
| 5,401,184 | A | 3/1995 | Sundstrom et al. | |
| 5,505,634 | A | 4/1996 | Osten | |
| 5,649,835 | A | 7/1997 | Weed | |
| 5,772,462 | A | 6/1998 | Osten | |
| 6,602,087 | B1 | 8/2003 | Carle | |
| 6,896,537 | B2 | 5/2005 | Burton | |
| 7,303,418 | B2 * | 12/2007 | O'Connor | 439/277 |

* cited by examiner

*Primary Examiner* — Ross N Gushi
(74) *Attorney, Agent, or Firm* — Norman E. Lehrer

(57) ABSTRACT

An electrical cord coupling device includes an elongated generally cylindrical hollow body having an interior surface, a first end, and a second end. A first end cap is removably secured to the first end of the body. A hollow generally cylindrical adapter member is telescopingly received within the second end of the elongated body and a second end cap is removably secured the adapter member. The elongated body is adapted to house a plug of a first electrical cord and a socket of a second electrical cord coupled together. The first and second end caps prevent the cords from detaching when the end caps are secured to their respective ends of the elongated body and the adapter member. Each of the end caps is separable into two parts so as to be able to be positioned around the cords.

2 Claims, 5 Drawing Sheets

ELECTRICAL CORD COUPLING DEVICE

BACKGROUND OF THE INVENTION

The present invention is directed toward an electrical cord coupling device and more particularly, toward a device that will prevent electrical cords (particularly extension cords) from inadvertently disconnecting.

A typical electrical extension cord has a male end or plug and a female end or socket. Electrical cords are often connected together by mating the female end of one cord with the male end of another cord, thereby extending the length of the cords. This is helpful in various situations such as housework, yard work, as well as industrial businesses. Because the connection is a friction fit, however, the cords tend to disconnect quite easily when pulled apart inadvertently. This can create a potentially hazardous condition especially when powerful electrical tools or devices are in use. Furthermore, having to stop work every time the cords are pulled apart, reconnecting the cords, and then resuming work can become tedious, time-consuming, and a waste of time, money, and resources.

Efforts have been made to ensure that electrical cords do not disconnect inadvertently or to otherwise tighten the connection. For example, U.S. Pat. No. 3,281,755 to Trager discloses a end cap for electrical plug connections that prevents the inadvertent or accidental separation of female and male connector plugs. However, this device does not appear to accommodate plug connections of varying sizes.

Also, U.S. Pat. No. 4,911,654 to Blaetz discloses an extension cord protection and locking device for securing and enclosing electrical connectors. U.S. Pat. No. 5,393,243 to Carmo discloses a plug and socket connector clamp for maintaining engagement between an electrical plug and mating socket connector. These patents also do not appear to allow for a wide variety of plugs and sockets to be used with the protecting devices.

Therefore, a need exists for a simple extension cord coupling device that prevents the cords from separating inadvertently and may be used with a wide variety of plugs and sockets.

SUMMARY OF THE INVENTION

The present invention is designed to overcome the deficiencies of the prior art discussed above. It is an object of the present invention to provide an electrical cord coupling device that prevents electrical extension cords from inadvertently disconnecting.

It is another object of the present invention to provide an electrical cord coupling device that may be used with a wide variety of plugs and sockets of varying sizes.

In accordance with illustrative embodiments demonstrating features and advantages of the present invention, there is provided an electrical cord coupling device that includes an elongated generally cylindrical hollow body having an interior surface, a first end, and a second end; a first end cap removably secured to the first end of the body; a second end cap removably secured the second end of the body; and a hollow generally cylindrical adapter member telescopingly received within one of the ends of the elongated body. The elongated body is adapted to house a plug of a first electrical cord and a socket of a second electrical cord coupled together. The first and second end caps prevent the cords from detaching when the end caps are secured to their respective ends of the elongated body. The adapter member allows for plugs and sockets of varying sizes to be housed within the elongated body. Each of the end caps includes a left half and a right half with means for disconnecting and connecting the halves together.

Other objects, features, and advantages of the invention will readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
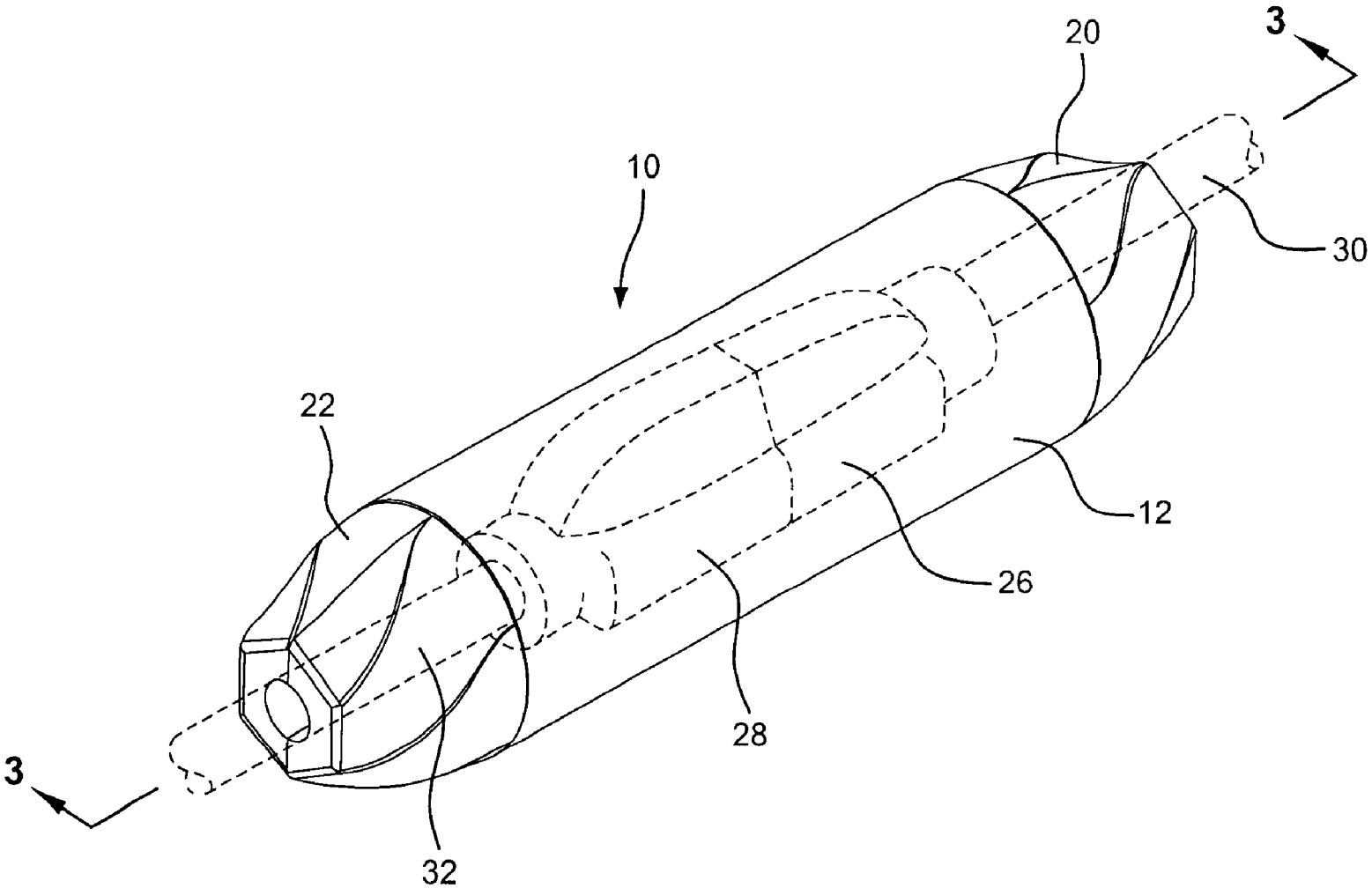
FIG. 1 is a front perspective view of the electrical cord coupling device of the present invention with the male and female ends of the electrical cords shown in phantom.

Referring now to the drawings in detail wherein like reference numerals have been used throughout the various figures to designate like elements, there is shown in FIG. 1 an electrical cord coupling device constructed in accordance with the principles of the present invention and designated generally as 10.

Figure 2:
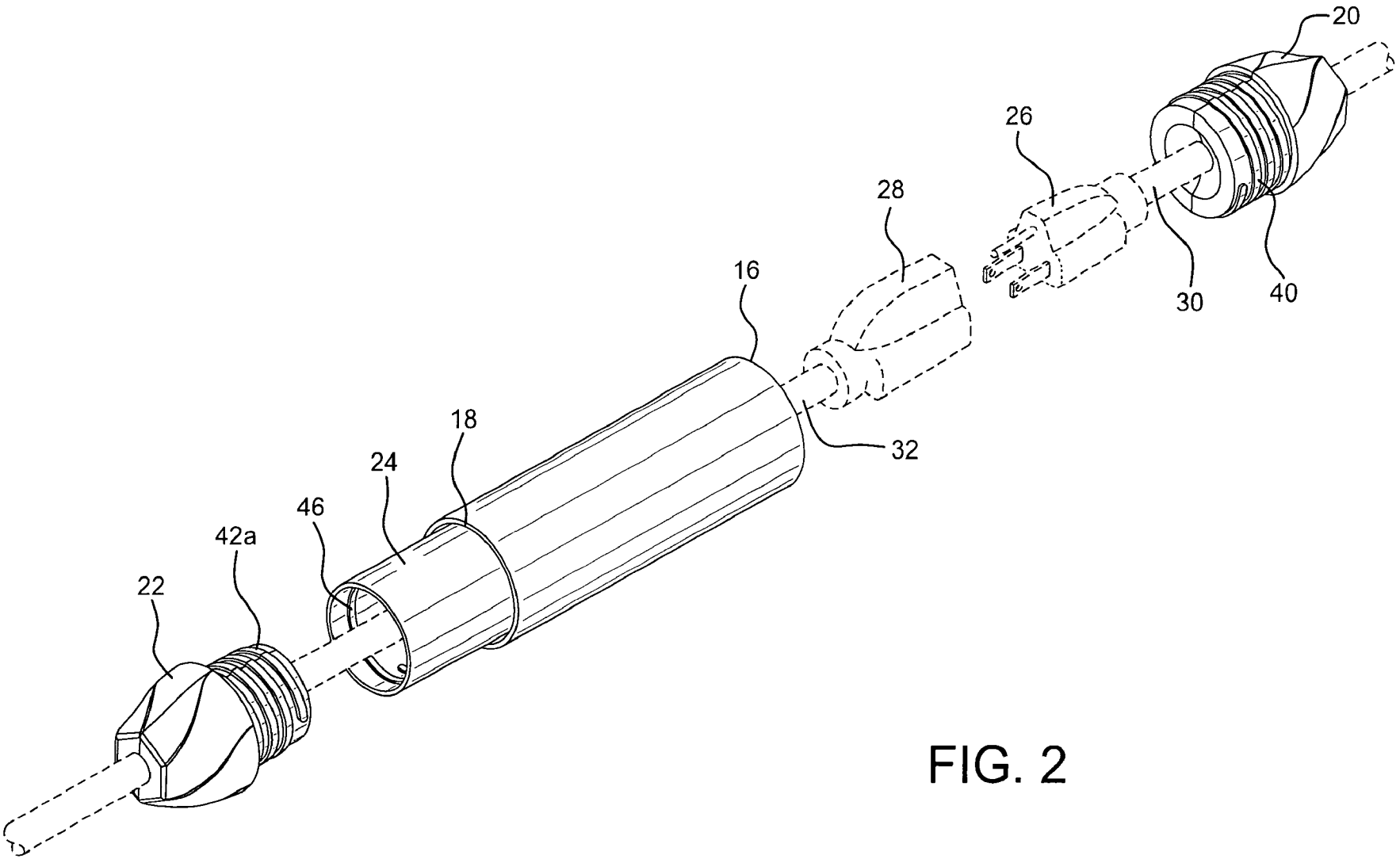
FIG. 2 is a partially exploded view of the electrical cord coupling device of the present invention shown in FIG. 1.

The electrical cord coupling device of the present invention essentially includes an elongated generally cylindrical hollow body 12 having an interior surface 14, a first end 16, and a second end 18; a first end cap 20 removably secured to the first end 16 of the body 12; a hollow generally cylindrical adapter member 24 telescopingly received within the second end 18 of the elongated body 12 and a second end cap 22 removably secured to the cylindrical adapter member 24. (See FIG. 2.)

The elongated body 12 is adapted to house a plug 26 of a first electrical cord 30 and a socket 28 of a second electrical cord 32 coupled together. The first and second end caps 20 and 22, respectively, prevent the cords from detaching when the end caps are secured to their respective ends 16 and 18 of the elongated body 12. The adapter member 24 allows for plugs and sockets of varying sizes to be housed within the elongated body as will be described in greater detail below.

Figure 3:
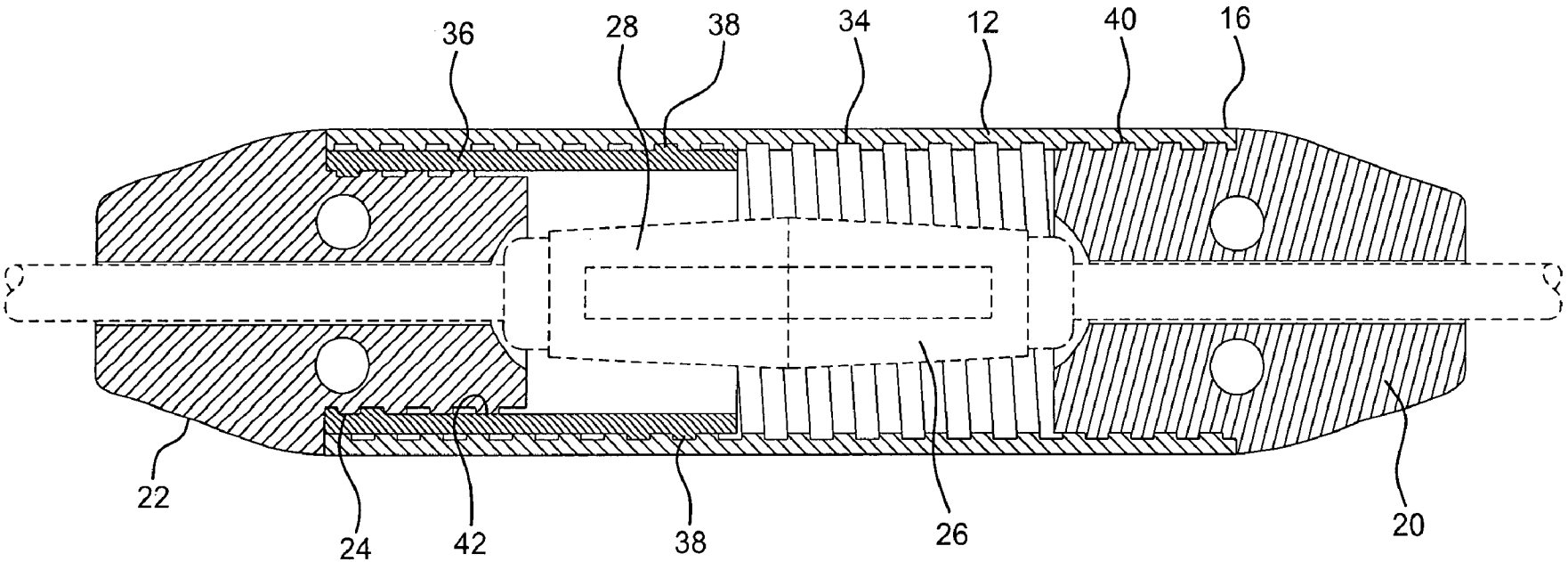
FIG. 3 is a cross-sectional view of the electrical cord coupling device of the present invention taken through the lines 3-3 of FIG. 1.

The interior surface 14 of the elongated body 12 includes screw threads 34 and the outer surface 36 of the adapter member 24 includes screw threads 38 complimentary to the screw threads 34 of the elongated body 12. (See FIG. 3.) The first end cap 20 also includes screw threads 40 that are complimentary to the screw threads 34 of the elongated body 12. Similarly, the outer surface of the second end cap 22 and the interior 48 of the adapter member 24 each includes complimentary screw threads 42 and 46, respectively, for removably securing the second end cap 22 to the adapter member 24.

Figure 4:
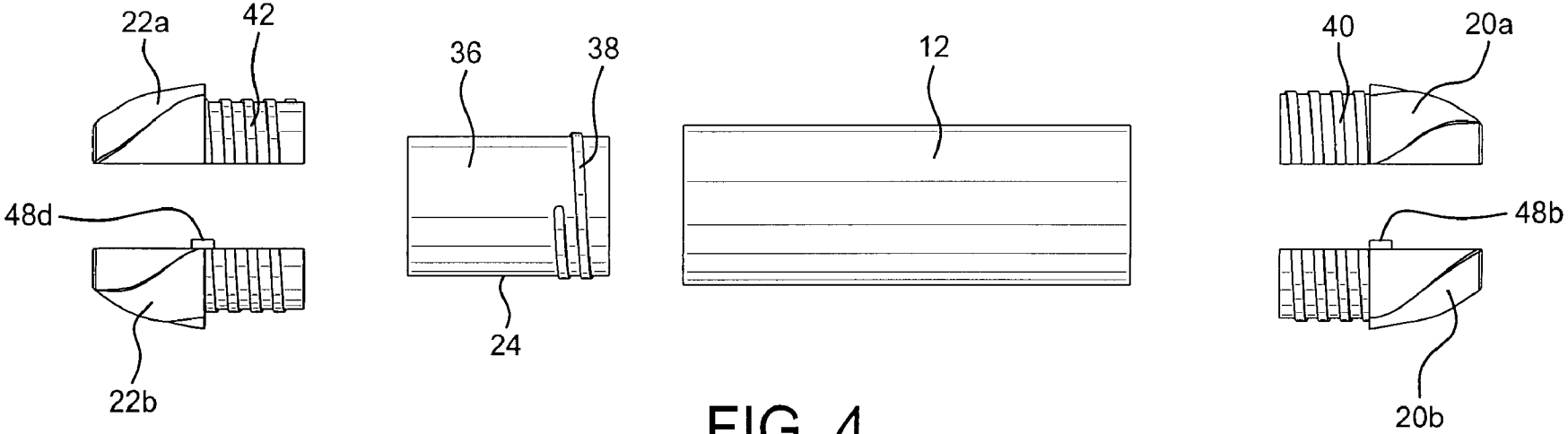
FIG. 4 is a top exploded view of the electrical cord coupling device of the present invention shown in FIG. 1.
Figure 6:
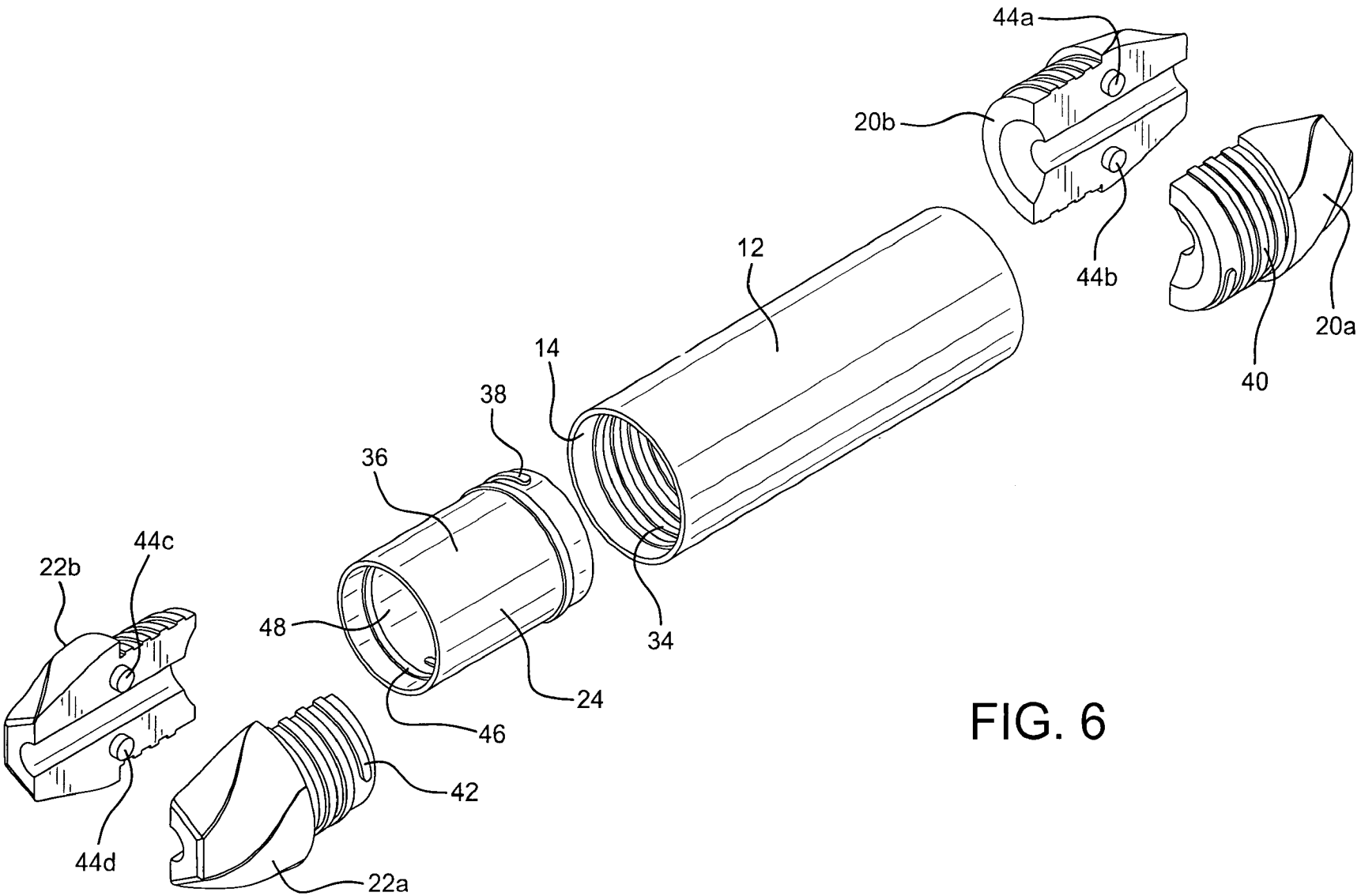
FIG. 6 is a front perspective and fully exploded view of the electrical cord coupling device of the present invention.

First end cap 20 is made of two parts. It includes a top half 20*a* and a bottom half 20*b* with means, such as pins 44*a* and 44*b* and apertures (not shown) into which a respective pin fits, for disconnecting and connecting the halves together. Similarly, end cap 22 includes a top half 22*a* and a bottom half 22*b* with means, such as pins 44*c* and 44*d* and apertures (not shown) into which a respective pin fits, for disconnecting and connecting the halves together. (See FIGS. 4 and 6.) Each half of each end cap may be pulled apart and then snapped back together. This structure allows the electrical cords to be easily secured within the device as will be described in greater detail below.

Figure 5:
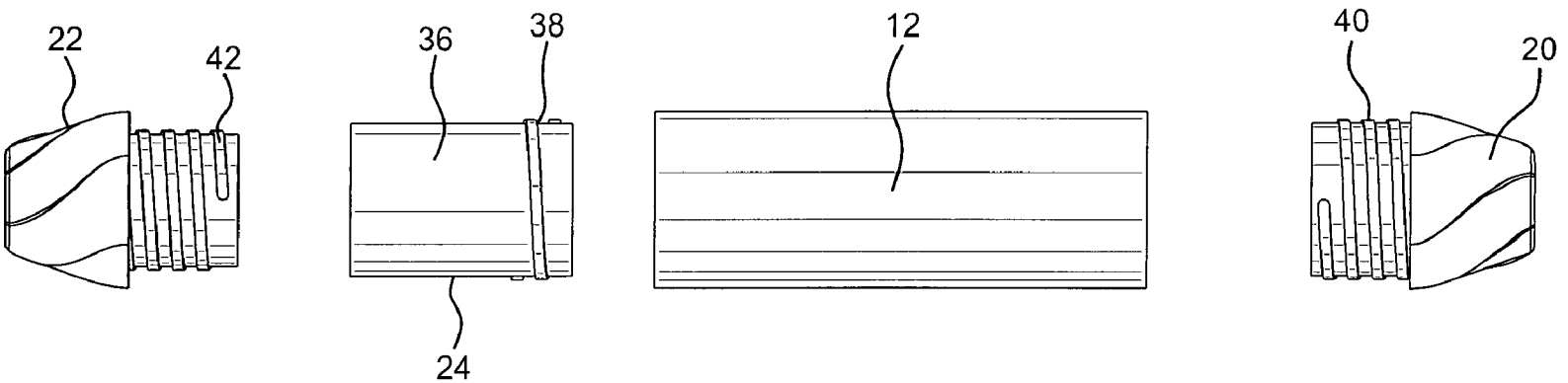
FIG. 5 is a front exploded view of the electrical cord coupling device of the present invention shown in FIG. 1.

In order to use the electrical cord coupling device of the present invention, the end caps 20 and 22 must be removed from the elongated body 12 and cylindrical adapter member 24, respectively. The length of one of the electrical cords 30 or 32 is then threaded through the elongated body 12 and the cylindrical adapter member 24. The cords are then connected to each other and the plug 26 and socket 28 connection of the cords 30 and 32, respectively, are positioned within the elongated body 12. Each of the end caps are then split apart (see FIG. 4) and then reconnected (see FIG. 5) about the cords. For example, the first end cap 20 may be snapped together about the cord 30 adjacent the first end 16 of the elongated body 12 and the second end cap 22 may be snapped together about the cord 32 adjacent the second end 18 of the elongated body 12. (See FIG. 2.)

The first end cap 20 is then be screwed onto the first end 16 of the elongated body 12 and the second end cap 22 is then screwed into the cylindrical adapter member 24 which, in turn, is screwed into the second end 18 of the elongated body 12. The end caps 20 and 22 and the cylindrical adapter member 24 are adjusted so that the socket 28 and plug 26 abut the inside proximate ends of the end caps 22 and 20, respectively. In this manner, if the cords are inadvertently pulled apart, the end caps will prevent the plug and socket from disconnecting. (See FIGS. 1 and 3.)

In the embodiment of the invention shown in the figures and as described above, the threads 34 on the inside of the elongated body 12 and the threads 38 on the adapter member 24 are continuous, i.e. they extend circumferentially all the way around the members. It is also possible to interrupt the threads on both the body 12 and the adapter member 24 and leave larger gaps that run axially. In this way, with the adapter member 24 and the elongated body 12 properly aligned, the adapter member 24 can be slid into the center of the body 12 to its desired position and then twisted a quarter or half turn to engage the threads to lock the two parts together.

The present invention may be embodied in other specific forms without departing from the spirit or essential attributes thereof and accordingly, reference should be made to the appended claims rather than to the foregoing specification as indicating the scope of the invention.

I claim:

1. An electrical cord coupling device comprising:

an elongated generally cylindrical hollow body having an interior surface, a first end, and a second end;

a first two-part end cap including a left half and a right half separable from each other and including an external thread on the outer surface of each of said left and right halves, said first end of said body including an internal thread therein complimentary to said external thread on said first end cap, said first end cap being adapted to be threaded into said first end of said body whereby said first end cap can be removably secured to said first end of said body by threading said first end cap into said first end of said body and whereby said left and right halves of said first end cap are secured together;

a hollow generally cylindrical adapter member telescopingly received within said second end of said elongated body;

a second two-part end cap including a left half and a right half separable from each other and including an external thread on the outer surface of each of said left and right halves, said adapter member including an internal thread therein complimentary to said external thread on said second end cap, said second end cap being adapted to be threaded into said adapter member whereby said second end cap can be removably secured to said cylindrical adapter member by threading said second end cap into said adapter member and whereby said left and right halves of said second end cap are secured together;

wherein said elongated body is adapted to house a plug of a first electrical cord and a socket of a second electrical cord coupled together, said first and second end caps preventing the cords from detaching when said end caps are secured to said elongated body and said adapter member.

2. The electrical cord coupling device of claim 1 wherein said interior surface of said elongated member includes screw threads and said adapter member includes screw threads complimentary to said screw threads of said elongated body.

* * * * *